US006412414B1

(12) United States Patent
Loos

(10) Patent No.: US 6,412,414 B1
(45) Date of Patent: Jul. 2, 2002

(54) METHOD AND DEVICE FOR REMOVING A CLEANING DEVICE FROM A PRINTING PRESS

(75) Inventor: Gerhard Loos, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/416,026

(22) Filed: Oct. 8, 1999

(30) Foreign Application Priority Data

Oct. 8, 1998 (DE) ..... 198 46 386

(51) Int. Cl.[7] ..... B41F 35/00
(52) U.S. Cl. ..... 101/425; 101/423
(58) Field of Search ..... 101/483, 423, 101/424, 425; 15/256.51, 256.5; 399/123, 345

(56) References Cited

U.S. PATENT DOCUMENTS

| | | | | | |
|---|---|---|---|---|---|
| 2,969,735 | A | * | 1/1961 | Cope et al. | 101/425 |
| 3,898,929 | A | * | 8/1975 | Arild et al. | 101/425 |
| 4,162,652 | A | * | 7/1979 | Rebel et al. | 101/425 |
| 5,105,740 | A | | 4/1992 | Loos et al. | 101/425 |
| 5,224,424 | A | * | 7/1993 | Layland | 101/425 |
| 5,331,891 | A | * | 7/1994 | Sugiyama et al. | 101/424 |
| 5,450,792 | A | * | 9/1995 | Gegenheimer et al. | 101/425 |
| 5,769,461 | A | | 6/1998 | Hildebrandt et al. | 285/29 |
| 5,870,954 | A | * | 2/1999 | Lovenstein et al. | 101/423 |

FOREIGN PATENT DOCUMENTS

| | | |
|---|---|---|
| DE | 3909119 A1 | 9/1990 |
| DE | G9213605.2 | 12/1992 |
| DE | 19609737 C1 | 5/1995 |
| DE | 19634592 A1 | 3/1997 |
| DE | 19506640 C2 | 9/1998 |

* cited by examiner

*Primary Examiner*—Andrew H. Hirshfeld
*Assistant Examiner*—Anthony H. Nguyen
(74) *Attorney, Agent, or Firm*—Laurence A. Greenberg; Werner H. Stemer; Gregory L. Mayback

(57) ABSTRACT

A method of removing from a printing machine, with the aid of a traverse of the printing machine, a cleaning device assigned to a cylinder, which comprises, in a first method step, shifting the traverse out of a parallel position relative to the cylinder, wherein a side wall of the printing machine blocks a movement of the cleaning device, guided by the traverse, out of the printing machine, into an inclined position relative to the cylinder, the cleaning device guided by the traverse being movable past an outer contour of the side wall or through an opening formed in the side wall, and out of the printing machine, and, in a second method step, moving the cleaning device, guided by the traverse, in the longitudinal direction of the traverse and out of the printing machine; an assembly for performing the method; and a printing machine having at least one assembly for performing the method.

7 Claims, 4 Drawing Sheets

METHOD AND DEVICE FOR REMOVING A CLEANING DEVICE FROM A PRINTING PRESS

BACKGROUND OF THE INVENTION

FIELD OF THE INVENTION

The invention relates to a method for removing from a printing press, through the intermediary of a traverse, a cleaning device assigned to a cylinder, and further relates to a device for removing from a printing press a cleaning device assigned to a cylinder, the removing device including a traverse in the printing press, the traverse being adjustable with respect to the cylinder into two different positions, and the cleaning device being removable from the printing press by the traverse in the longitudinal direction of the latter.

The necessity for removing a cleaning device from a printing press can, in practice, for example, result from having to exchange a new and clean cleaning cloth, that is able to be wound up and unwound, instead of a used-up and soiled cleaning cloth. The exchange of the cleaning cloths generally requires good accessibility of the cleaning device, which is not provided for a cleaning device found within the printing press. Special problems result when the cleaning device located between two side walls of the printing press during the use thereof cannot be lifted from between the side walls in a direction parallel thereto.

An impression-cylinder washing device for sheetfed printing presses is described in Japanese Patent 25 78 123, the main body of the washing device being displaceable on a rail perpendicularly to the side walls. The rail extends through an opening formed in the lower section of an impression cylinder through the side wall.

An opening in the side wall aligned in-register with the cleaning position of the cleaning device is undesirable or altogether impossible in many cases. For example, in another type of printing press than that shown in the Japanese Patent 25 78 123, at the inner side of the side wall, transmission members, pipelines or the like can be arranged, by which an opening in the side wall in the vicinity of the insert location of the cleaning device is blocked, and the removal of the cleaning device through the opening is consequently not realizable.

A printing press cylinder-washing device is described in German Petty Patent No. 92 13 605.2 and has a washing beam connected by a linear guiding device to a suspension device, by which the washing beam can be driven out of the printing unit in the longitudinal direction of the washing beam and again driven in. The suspension device is swivellable relative to a cylinder via linkages out of a first parallel position into a second parallel position, but not, however, in an inclined position. This device exclusively allows the washing beam to be extended and retracted axially parallel to the cylinder and is suited only for printing presses having side supports with an opening below the lower half of the cylinder. Thus, the deficiencies of the device of the aforementioned Japanese Patent 25 78 123 are not remedied by this washing device.

Furthermore, there is described in the published German Patent Document DE 19 63 6985 C1, a device nongeneric to the foregoing for feeding printing ink from a printing-ink cartridge to an inking unit of a rotary printing press, the printing-ink cartridge and the appertaining device for conveying printing ink being arranged in a traverse the position of which is variable with respect to the side frames of the rotary printing press or which is swivellable on a side frame.

No suggestions for solving the problems associated with the removal of a cleaning device from a printing press can be derived from this document. The device for conveying printing ink and the printing-ink cartridge arranged in the traverse is in no way comparable with a cleaning device. The small and very handy cartridge identified by the reference numeral 11 in this reference can be placed manually between the illustrated piston 23 and the outlet 26 on the traverse and can be removed from the traverse in an equally simple manner. The traverse possesses no guiding function generally in this regard.

SUMMARY OF THE INVENTION

It is an object of the invention to provide a method for removing with a traverse a cleaning device from a printing press, and a device for removing a cleaning device, including a traverse in a printing press by which, for many types of printing press constructions, the cleaning device can be removed from the printing press without great effort.

With the foregoing and other objects in view, there is provided, in accordance with a first aspect of the invention, a method of removing from a printing machine, with the aid of a traverse of the printing machine, a cleaning device assigned to a cylinder, which comprises, in a first method step, shifting the traverse out of a parallel position relative to the cylinder, wherein a side wall of the printing machine blocks a movement of the cleaning device, guided by the traverse, out of the printing machine, into an inclined position relative to the cylinder, the cleaning device guided by the traverse being movable past an outer contour of the side wall or through an opening formed in the side wall, and out of the printing machine, and, in a second method step, moving the cleaning device, guided by the traverse, in the longitudinal direction of the traverse and out of the printing machine.

By this method, the cleaning device, without any great effort, for example, for servicing purposes, can be removed from the printing machine by the pressman.

An introduction of the cleaning device into the printing machine by the traverse can take place in accordance with a method wherein, in a first method step, the cleaning device, guided by the traverse in the longitudinal direction of the traverse, is moved into the printing machine, and in a second method step, the traverse is adjusted out of the inclined position, the cleaning device, guided by the traverse past the outer contour or through an opening in the side wall, being movable into the printing machine and into the parallel position wherein a side wall of the printing machine blocks a movement of the cleaning device out of the printing machine, the movement being guided by the traverse.

In accordance with a second aspect of the invention, there is provided an assembly including a cleaning device assigned to a cylinder, and comprising a traverse in a printing machine, the traverse being adjustable with respect to the cylinder into two different positions, and the cleaning device being removable from the printing machine in the longitudinal direction of the traverse with the aid of the traverse, the traverse being selectively adjustable into a parallel position and an inclined position relative to the axis of the cylinder.

An assembly constructed in such a manner ensures a very operationally reliable adjustment of the traverse out of a position axially parallel to the cylinder and perpendicular to the side wall into a position inclined both to the cylinder as well as to the side wall. It is understood that by the term cylinder there is meant, for example, printing unit cylinders, sheet transport drums and inking unit rollers. The assignment of the cleaning device to the cylinder can, on the one hand, serve for cleaning the peripheral jacket surface of the cylinder and a cylinder covering or dressing forming it, respectively, or, on the other hand, the cleaning of printing material guided on the cylinder. In the last-mentioned case, the cleaning device may, for example, be based upon the brush principle.

This device offers the advantage that, for removing and naturally also for introducing the cleaning device, an offset opening can be provided for inserting the cleaning device into position, the opening being formed in a region of the side wall where this opening causes no trouble. In the device according to the invention, a window-shaped opening in the side wall can advantageously in many cases be completely dispensed with, if the traverse is adjustable so that the cleaning device can be guided past the outer contour of the side wall. The outer contour of the side wall which the cleaning device can be guided past can extend in the plane of the side wall in any desired direction and, for example, horizontally. If the side wall forms a so-called printing unit tower wherein the cleaning device, for example, for cleaning a rubber blanket cylinder, is arranged, the outer contour, for example, can extend substantially in a vertical direction. At the location at which the cleaning device is guided past the outer contour, the latter may be formed with an outwardly open trough-shaped recess through which the cleaning device is guided.

In accordance with another feature of the invention, the traverse is swivellable about a swivel joint into the parallel position and the inclined position.

A swivel traverse is constructively especially inexpensive, and adjustable quite simply into positions relative to the cylinder.

In accordance with a further feature of the invention, the traverse is swivellable into approximately a vertical plane. For example, the traverse can be swivelled about a swivel axis extending horizontally as well as perpendicularly to the cylinder axis in the vertical plane, out of the parallel position and into the position wherein it is inclined relative to the cylinder. When the traverse is located in the inclined position, the cleaning device can slide on the traverse, like on a sloping or inclined plane surface, in a lateral direction out of the printing machine and through an opening in the side wall.

In accordance with an alternative feature of the invention, the traverse is swivellable into approximately a horizontal plane.

A traverse formed in such a manner can be swivelled about the swivel joint selectively into the parallel position and the inclined position and is particularly suited for development as a support table. In specific cases, the traverse can be constructed as a linear guide in the form of a guide rail or of several mutually parallel guide rails, whereon the cleaning device may inserted and slid or whereon the cleaning device may be hung or between which the cleaning device may be suspended. The cleaning device can be movable on the traverse rollingly or slidingly into and out of the printing machine.

In accordance with an added feature of the invention, the traverse is supported at both ends in the inclined position. A traverse having such a stable construction does not tend towards oscillations when the cleaning device is placed or hung thereon. In addition, the traverse cannot be damaged and, for example, bent if the pressman braces himself thereon. The demands on the stability of the swivel joint which can form a support for bracing the traverse at one end of the traverse are not so high for the double-ended supported swivellable traverse as for a swivellable traverse with an unsupported traverse end, so that a comparatively small-dimensioned joint can be provided. Of course, the traverse can also be supported at both ends when the position thereof is parallel to the cylinder.

In accordance with an additional feature of the invention, the traverse in the inclined position is supported at a traverse end, and additionally supported by a swivellable support at a further support location offset in the longitudinal direction of the traverse.

Advantageously for this embodiment, the swivellable support can be swung into the region between the side walls, so that the swivellable support does not protrude and, for example, a flap-shaped protective covering of the printing machine, when the traverse is swung in, is closable behind the latter. Preferably, the traverse can be supported in the inclined position by a swivel joint at a first traverse end, and by a support swivellable about a further swivel joint at a second traverse end. The swivel joint of the traverse can, in this regard, be fastened to a side wall, and the swivel joint of the support can be fastened to the opposite side wall of the printing-machine frame. By such a construction, a constructively inexpensive and, nevertheless, very stable double-ended support of the traverse is attained.

In accordance with yet another feature of the invention, the swivellable support is movably connected via a sliding joint to the traverse.

It is thereby desirable that, for inward and outward swinging of the traverse, the support is simultaneously entrainable. The slide joint can preferably be formed as a coulisse or sliding-block guide. A groove or a slot of the coulisse guide is preferably formed in the traverse, and a sliding arm or crank or such a roller is preferably fastened to the swivellable support. In a transposed arrangement, the groove can also be formed on the swivellable support, and the sliding arm or crank on the traverse. Preferably, the swivel joint is formed on one traverse end, and the sliding joint near the other traverse end. In many applications, the sliding joint, however, also in a middle region of the traverse, can connect the latter to the support. This may be advantageous, for example, if the swivellable support has a comparatively long dimension. In other applications, the sliding joint can be disposed near the traverse end, whereon the swivel joint of the traverse is formed, the swivellable support being able to serve for the stabilization of the swivel joint. In this regard, the swivel joint of the traverse and the swivel joint of the support can be fastened horizontally offset from one another on one and the same side wall.

In accordance with yet a further feature of the invention, the traverse is formed as a substantially U-shaped profiled supporting table.

Such a supporting table affords a particularly reliable support of the cleaning device, even if it is very difficult and troublesome, due to its size, to handle. The supporting table can thus form lockingly surround the cleaning device on the outside from below by the U-shaped profiling, so that, when the cleaning device is moved in the longitudinal direction of the traverse, guidance on both sides is provided, which secures the cleaning device in the insert position thereof. In this regard, it is noted that a formlocking connection is effected by the shapes of two elements, as opposed to a forcelocking connection wherein two elements are connected together by force external to the elements.

The assembly according to the invention is provided for printing machines and especially for rotary printing machines. The application thereof for cleaning a rubber blanket cylinder of an offset printing machine is particularly desirable.

Other features which are considered as characteristic for the invention are set forth in the appended claims.

Although the invention is illustrated and described herein as embodied in a method and assembly for removing a cleaning device from a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
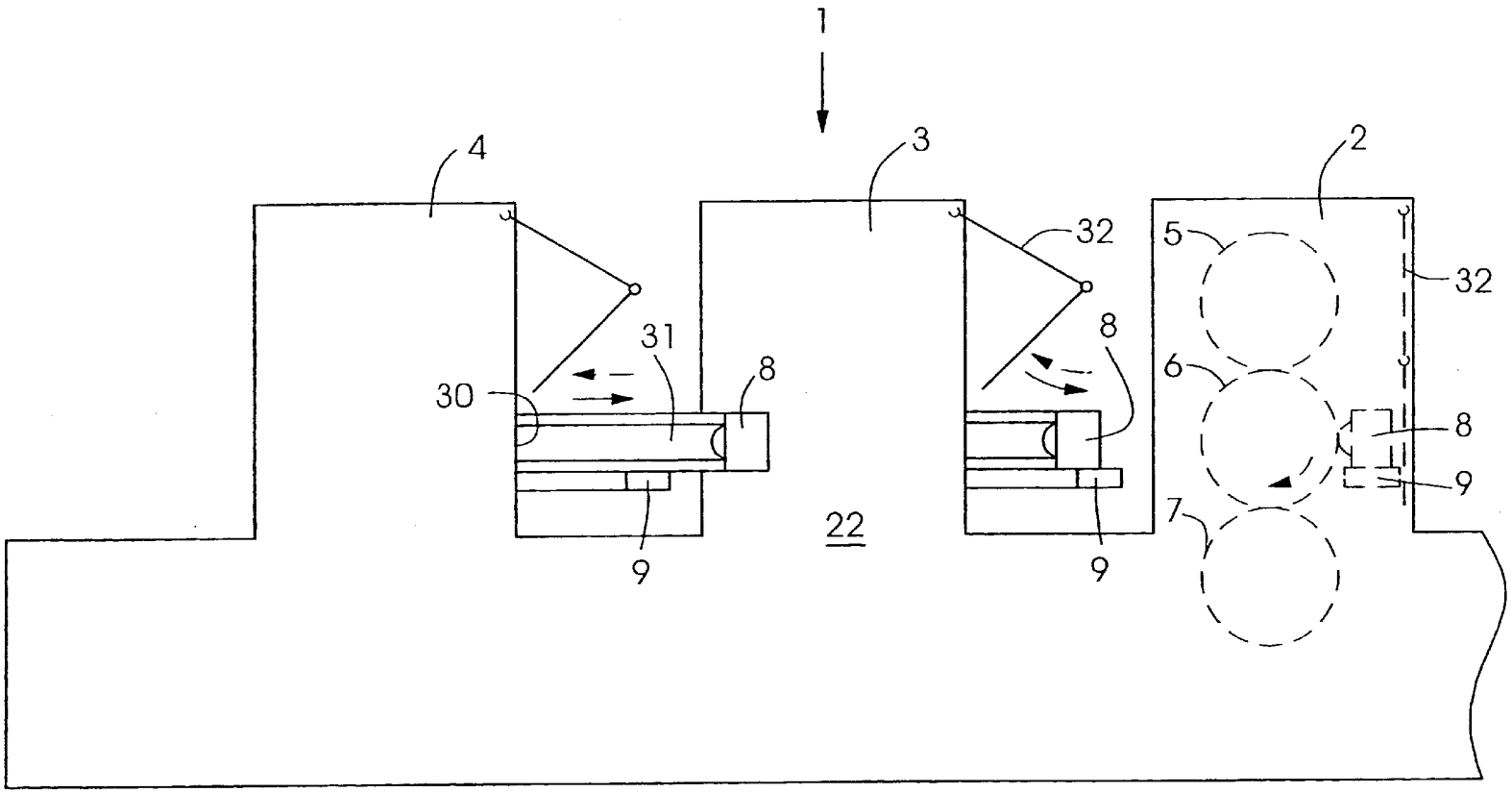
FIG. 1 is a diagrammatic fragmentary side elevational view of a printing press in unit construction with several printing unit towers to which a respective assembly for removing a cleaning device in accordance with the invention is assigned, the respective assemblies being shown in three different positions, one of the assemblies being in operating position.

Referring now to the drawings and, first, particularly to FIG. 1 thereof, there is shown therein a printing press 1 including at least one assembly 8, 9 according to the invention. A cylinder 6 of the printing press that is to be cleaned is assigned to the assembly 8, 9. The printing press 1 is formed as an offset printing press, the cylinder 6 being a rubber blanket cylinder, which transfers the printing ink from the printing form cylinder 5 to the stock or printing material guided by an impression cylinder 7. The printing press 1 is formed as a printing press in unit construction with several printing unit towers 2 to 4, the devices 8, 9 of the various printing unit towers 2 to 4, for the purposes of illustration, being shown in different positions into which each of the assemblies 8, 9 are adjustable. The assembly 8, 9 of the printing unit 2 is located in the so-called operating position wherein an inwardly swung traverse 9 and a cleaning device 8 lying thereon are oriented in an axially parallel position to the cylinder 6. In this position of the assembly 8, 9, by a suitable engagement and disengagement actuation of the cleaning device 8, the effective cleaning element thereof can be brought selectively into contact with the circumferential jacket surface of the cylinder 6 and placed at a slight spacing from this circumferential jacket surface. The assembly 8, 9 is located between two frame side walls of the printing press which are disposed parallel to one another, of which in FIG. 1 only the front side wall 22 extending in the plane of the drawing is visible and covers the rear side wall 21 (FIGS. 3 to 5) of like shape. In these side walls 21 and 22, the assembly 8, 9 is supported and the cylinders 5 to 7 are also journalled in a conventional manner. A foldable protective cover 32 serves as a lateral (perpendicular to the plane of the drawing) covering of the interspace between the side walls 21 and 22 of the printing unit 2. As to the printing unit 2, the cover 32 extending in the vertical direction is shown in the closed covering position, and the assembly 8, 9 facing front-side to the cylinder 6 is shown in the rear-side covering position.

The cover 32 of the printing unit is openable, so that the printing unit is readily accessible and the assembly 8, 9 is removable from the region between the side walls 21, 22. For better clarity, this is represented, for example, in the printing units 3 and 4, which have a construction like that of the printing unit 2, wherein the protective cover 32 is removed out of the rear-side region of the assembly 8, 9 and folded open. Together with the cleaning device 8, the traverse 9 can be swung outwardly (the solid-line arrow) from the printing unit 3 relatively to the side wall 22. In contrast with the illustrated position of the assembly 8, 9 of the printing unit 2, for example, the side wall 22 then no longer obstructs a displacement of the cleaning device 8 in the longitudinal direction of the traverse 9, so that the cleaning device 8 can be removed from the printing machine past the outer contour 30 and the side edge of the side wall 22, respectively, as the assembly 8, 9, for example, of the printing unit 4 shows and is symbolically represented by the solid-line arrow. Only a slight spacing between the thereby next arriving points and surfaces 30, 31, respectively, of the cleaning device 8 and the side wall 22, respectively, is required, for guiding the cleaning device 8 past the side wall 22. The introduction of the cleaning device 8 into the printing machine 1 occurs in reversed sequence, the cleaning device 8 being initially placed on the traverse 9 and slid thereon, as is represented by the broken-line arrow on the device 8, 9 of the printing unit 4. In the exemplary printing unit 3, the traverse 9 shown together with the cleaning device 8 that is disposed in a completely inserted position thereon wherein it no longer projects past the outer contour 30 of the side wall 22, can be swung in horizontal direction out of the region outside the printing unit 3 and into aligned overlapping with the side wall 22 and into the interspace between the side walls 21 and 22, respectively, as is represented by the broken-line arrow. After the assembly 8, 9 has been swung in, the covering 32 can be closed behind the assembly 8, 9.

Figure 2:
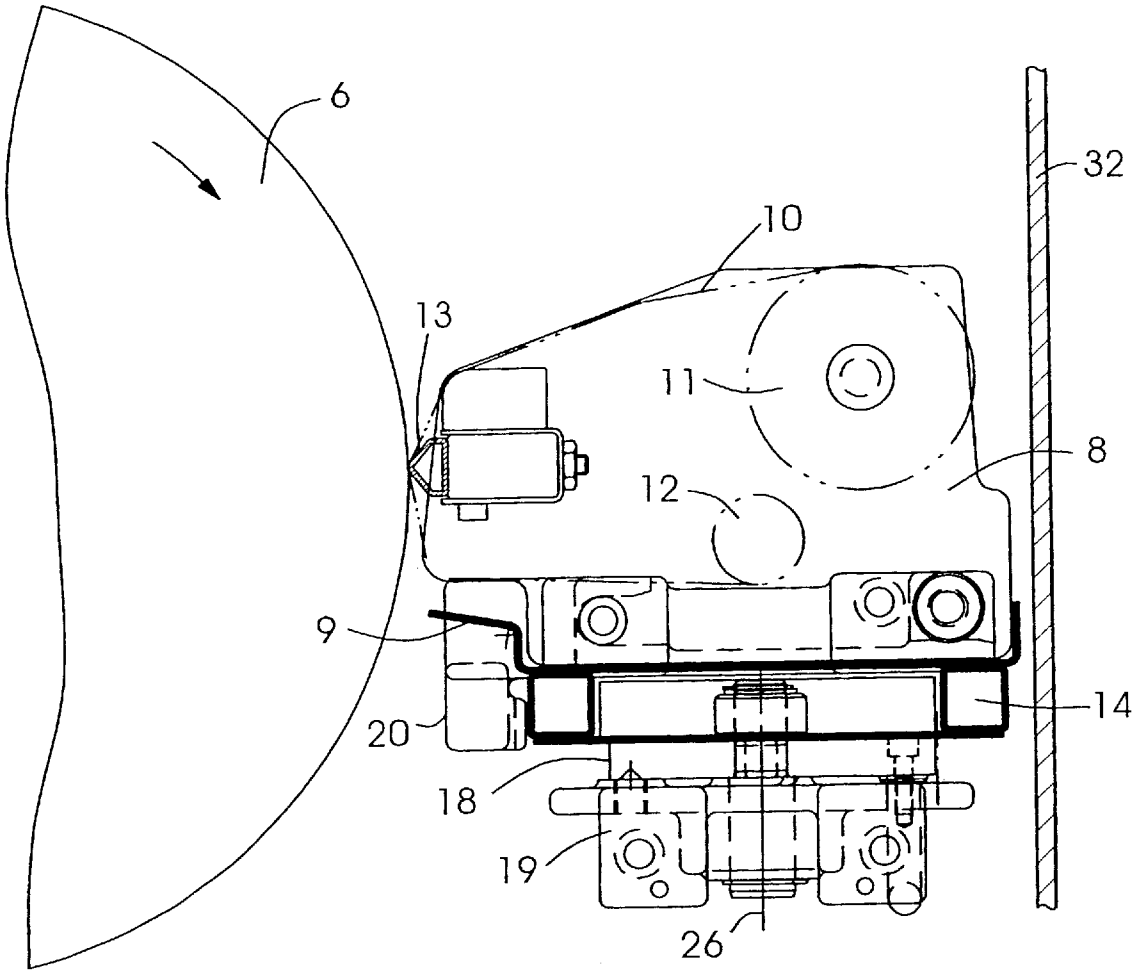
FIG. 2 is an enlarged fragmentary view of FIG. 1 showing the assembly that is in operating position with an inwardly swung traverse.

In FIG. 2, the assembly 8, 9 is shown in an enlarged view, so that the components are better recognizable. The effective cleaning element of the cleaning device 8 is a cleaning cloth 10, that is unwindable from a clean cloth coil or spool 11 and is windable on a soiled cloth coil or spool 12, and which runs over a pressure element 13 for pressing the cleaning cloth 10 from time to time against the peripheral jacket surface of the cylinder 6. The pressure element 13 is an elastic hollow profile extending axially parallel to the cylinder 6 over the axial length thereof, for engaging with the cleaning cloth 10. For cleaning and, for example, for improved loosening of printing ink residues, a cleaning fluid can be applied to the peripheral jacket surface of the cylinder 6. In addition, a cleaning cloth 10 wettable with the cleaning fluid and soaked therein, respectively, is used for the cleaning, the cleaning device 8, in both cases, being a washing device. Instead of a cleaning device 8 with a cleaning cloth 10 as the effective cleaning element, a cleaning device can also be provided with a rotating brush roller for cleaning the cylinder 6. The cleaning device 8 lies on the traverse 9 and is laterally guided thereby. The traverse 9, in an advantageous manner, is of lightweight construction and is formed of two square-shaped hollow profiles 14 extending mutually parallel in the longitudinal direction of the traverse 9. The hollow profiles 14 are connected to one another by an upper metal sheet or plate and by a lower metal sheet or plate, which are not otherwise identified. The upper metal sheet or plate is bent in a U-shaped manner in conformance with the shape of the cleaning device 8, so that it surrounds the cleaning device 8.

Figure 3:
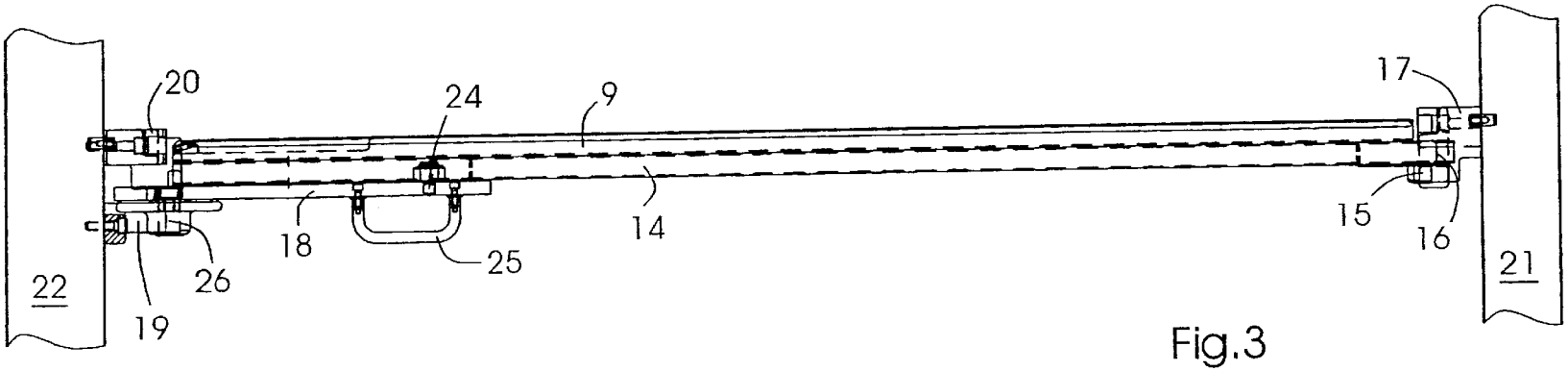
FIG. 3 is a side elevational view of the inwardly swung traverse of FIG. 2, with the cleaning device omitted.

In FIG. 3, the assembly 8, 9 is shown in a side view, the cleaning device 8 as well as the protective cover 32 having been omitted in the interest of providing greater clarity of the cylinder 6. The traverse 9 is swivellable about a vertically extending swivel shaft 15 disposed in the region of the traverse end shown at the right-hand side of the figure. The swivel shaft 15 is formed as a swivel joint, via which the traverse 9 is connected to a console-type traverse support 17 which, in turn, is fastened to the side wall 21.

With the aid of a handle 25, the traverse 9 can be moved out of the region between the side walls 21 and 22. The handle 25 is fastened to a support 18 holding the traverse 9 and being pivotable about a vertical swivel shaft 26. The swivel shaft 26 is formed by a further swivel joint 19, which is fastened to the side wall 22 by an otherwise non-illustrated console-type part and other parts.

Figure 4:
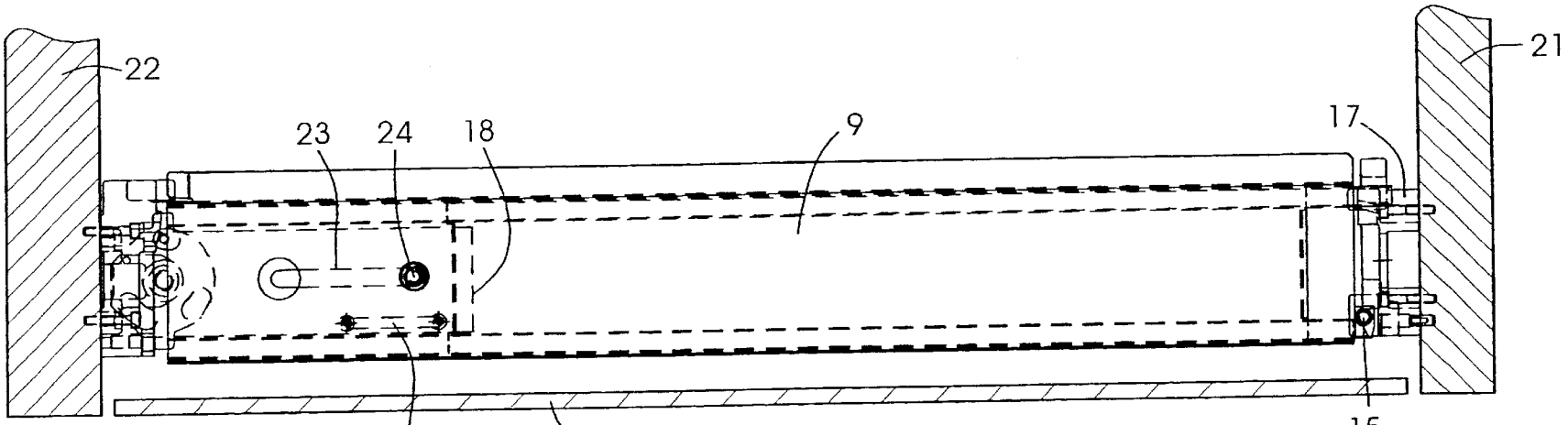
FIG. 4 is a top plan view of FIG. 3.

The traverse 9 of FIG. 3 is shown in plan view in FIG. 4, wherein the closed protective covering 32 is illustrated. It is apparent from FIG. 4, that the swivellable support 18, whereon the traverse 9 lies, is connected to the traverse 9 via a sliding joint 23, 24 and, more precisely stated, via a swivel and sliding joint 23, 24 having two degrees of freedom. The sliding joint 23, 24 formed as a coulisse or sliding-block guide that is made up of a slot 23 formed in the lower metal sheet of the traverse 9 and extending in the longitudinal direction of the traverse 9, and a pin or plug 24 guided in the slot 23 and fastened to the support 18.

Figure 5:
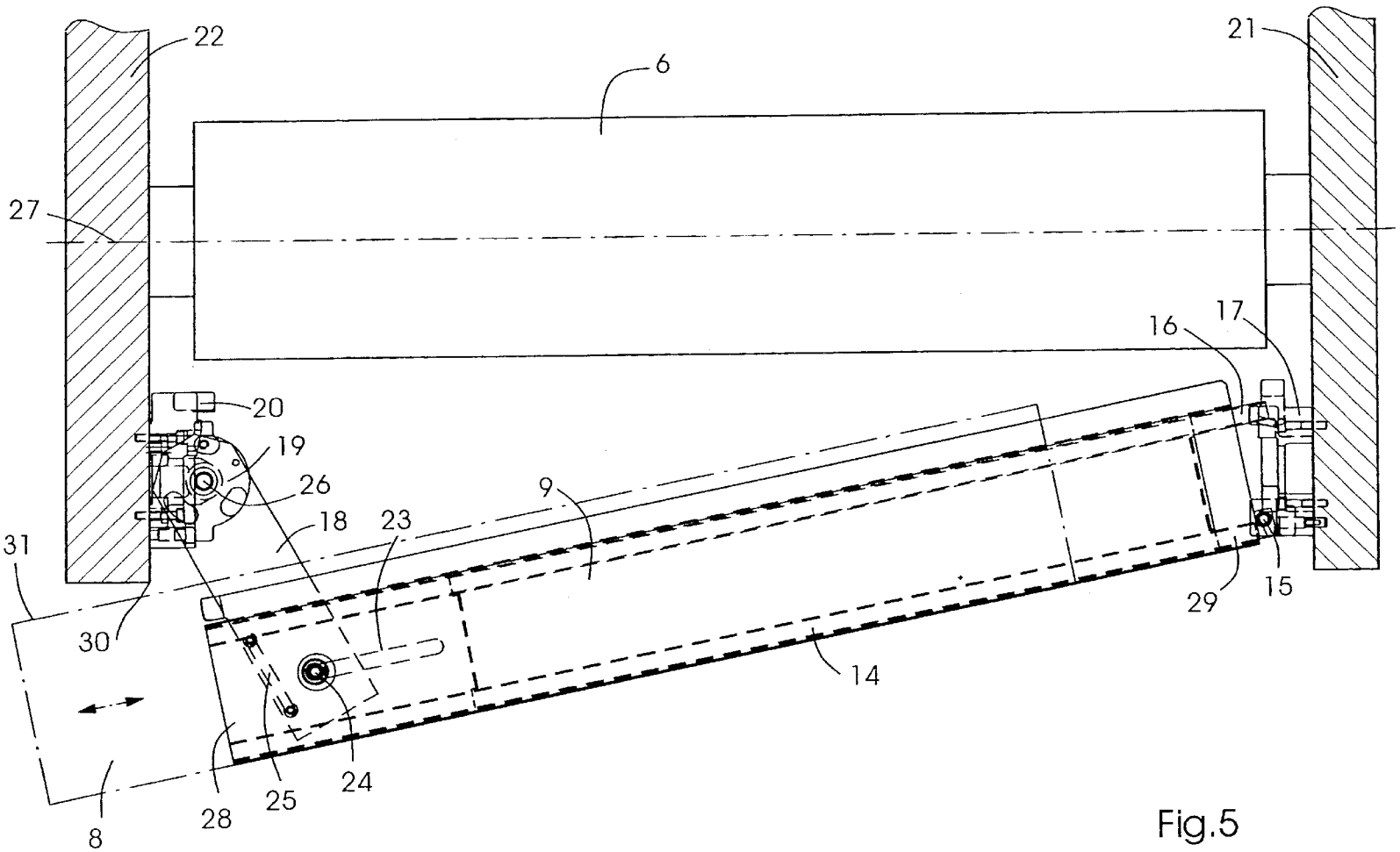
FIG. 5 is a diagrammatic plan view of the assembly according to the invention, including the traverse that is outwardly swung for the installation and removal of the cleaning device.

In FIG. 5, the traverse 9 of FIGS. 3 and 4 is shown in a condition wherein it is swung out from the covering of the traverse end 28 with the side wall 22. In FIG. 5, the cylinder 6 and, diagrammatically, the cleaning device 8 are also shown, it being apparent how the cleaning device 8 is drawn or slid past the outer contour 30 of the side wall 22 in the longitudinal direction of the traverse 9. In this regard, it is noted that not only an imaginary elongation of the traverse 9 adjusted for removal must run past the outer contour 30, but also, moreover, the outermost surface 31 of the cleaning device 8 facing towards the outer contour 30 must be guidable past the outer contour 30. The traverse 9 itself, the longitudinal extent of which corresponds substantially to that of the cylinder 6, is not guided past the side wall 21. The traverse end 29 lies with a support finger 16 of the traverse 9 on the traverse support 17 within the entire swivel range of the traverse 9. When the traverse 9 is swivelled, the support finger 16 slides on a contact surface formed on the traverse support 17.

Also, an otherwise non-illustrated eye of the joint 15 springing out of the traverse 9 lies on the traverse support 17. The support finger 16 is disposed on the edge facing towards the cylinder 6, and the joint 15 on the edge of the traverse end 29 lying away from the cylinder 6. In the region of the edge of the traverse end 28 lying diagonally to the joint 15, the traverse 9, in the swung-in position, abuts a stop 20 limiting the inward swing. The sliding joint 23, 24 forms a stop limiting the outward swing of the traverse 9, the traverse 9 being shown in FIG. 5 in the maximally outswung angular position. With respect to the position thereof shown in FIG. 4 and with respect to the cylinder axis 27, respectively, generally only a comparatively slight inclined position of, for example, 30° and preferably in the range of 5 to 15° and, for example, as shown, of about 10°, is required in order to guide the cleaning device 8 past the outer contour 30.

Instead of the swivellable support 18, there can be provided, in the case of another otherwise non-illustrated embodiment, an immovable support that is connected to the side wall 22 on the operating side, whereon the traverse 9 lies within the swivel region thereof. Also, the side wall 22 itself, serving as an abutment for the traverse end 28 that, for example, slides away in a groove formed in the side wall 22, can be constructed as an abutment.

I claim:

1. In combination with a printing machine including a cylinder having an axis, an assembly comprising:

a cleaning device assigned to the cylinder;

a swivel joint attached to the printing machine; and a traverse having a longitude;

said traverse swivellably attached to said swivel joint such that said traverse is adjustable into a first position in which said longitude of said traverse is parallel with the axis of the cylinder and into a second position in which said longitude of said traverse is inclined relative to the axis of the cylinder;

said cleaning device moveably guided by said traverse such that said cleaning device can be removed from the printing machine by moving said cleaning device along said longitude of said traverse;

said cleaning device movably guided by said traverse in a manner selected from the group consisting of being slidably guided by said traverse and being rollably guided by said traverse.

2. The combination according to claim 1, wherein said traverse in said inclined position is supported at a traverse end, and including a swivellable support for additionally supporting said traverse in said inclined position at a further support location offset in the longitudinal direction of said traverse.

3. The combination according to claim 2, including a sliding joint via which said swivellable support is movably connected to said traverse.

4. The combination according to claim 1, wherein said traverse is swivellable into approximately a vertical plane.

5. The combination according to claim 1, wherein said traverse is swivellable into approximately a horizontal plane.

6. The combination according to claim 1, wherein said traverse is supported at both ends in said inclined position.

7. The combination according to claim 1, wherein said traverse is formed as a substantially U-shaped profiled supporting table.

* * * * *